US011684836B2

(12) United States Patent
Jertson et al.

(10) Patent No.: US 11,684,836 B2
(45) **Date of Patent: *Jun. 27, 2023**

(54) GOLF CLUB HEADS WITH SOLE CAVITY PORTS AND RELATED METHODS

(71) Applicant: KARSTEN MANUFACTURING CORPORATION, Phoenix, AZ (US)

(72) Inventors: Martin R. Jertson, Cave Creek, AZ (US); Evan R. Greer, Phoenix, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/145,142

(22) Filed: Jan. 8, 2021

(65) Prior Publication Data

US 2021/0128998 A1 May 6, 2021

Related U.S. Application Data

(63) Continuation of application No. 16/548,676, filed on Aug. 22, 2019, now abandoned, which is a continuation of application No. 15/887,094, filed on Feb. 2, 2018, now Pat. No. 10,413,792, which is a continuation of application No. 15/209,425, filed on Jul. 13, 2016, now Pat. No. 9,925,442, which is a continuation of application No. 14/338,224, filed on Jul. 22, 2014, now Pat. No. 9,421,435.

(60) Provisional application No. 61/856,944, filed on Jul. 22, 2013.

(51) Int. Cl.

| | |
|---|---|
| ***A63B 60/02*** | (2015.01) |
| ***A63B 53/04*** | (2015.01) |
| ***A63B 53/00*** | (2015.01) |

(52) U.S. Cl.

CPC ..... *A63B 60/02* (2015.10); *A63B 53/047* (2013.01); *A63B 53/005* (2020.08); *A63B 53/0408* (2020.08); *A63B 53/0433* (2020.08); *A63B 2053/0479* (2013.01); *A63B 2053/0491* (2013.01)

(58) Field of Classification Search

CPC ..... A63B 60/02; A63B 65/047; A63B 2053/0491; A63B 53/005; A63B 53/0408; A63B 53/0433; A63B 2053/0479; A63B 53/047

USPC ..... 473/324–350, 287–292

See application file for complete search history.

(56) References Cited

U.S. PATENT DOCUMENTS

| | | | | |
|---|---|---|---|---|
| 4,687,205 A | | 8/1987 | Tominaga et al. | |
| 5,492,327 A | * | 2/1996 | Biafore, Jr. ..... | A63B 53/047 473/332 |
| 5,616,088 A | * | 4/1997 | Aizawa ..... | A63B 53/047 473/341 |
| 6,093,112 A | | 7/2000 | Peters et al. | |
| 6,290,607 B1 | | 9/2001 | Gilbert et al. | |

(Continued)

FOREIGN PATENT DOCUMENTS

| | | |
|---|---|---|
| JP | 2001046560 | 2/2001 |
| JP | 2011024999 | 2/2011 |

*Primary Examiner* — Sebastiano Passaniti

(57) ABSTRACT

The sole cavity ports described herein can have varying thicknesses across the cavity port lengths. In some embodiments, the golf club heads described herein can have a weight insertable into the sole port, wherein the weight can comprise a variable density. Other examples and related methods are also disclosed herein.

20 Claims, 8 Drawing Sheets

(56) References Cited

U.S. PATENT DOCUMENTS

| | | | | |
|---|---|---|---|---|
| 6,530,846 | B1 | 3/2003 | Mase et al. | |
| 6,881,158 | B2 | 4/2005 | Yang et al. | |
| 7,140,976 | B2 | 11/2006 | Chen et al. | |
| 7,513,835 | B2 | 4/2009 | Belmont et al. | |
| 7,530,903 | B2 | 5/2009 | Imamoto et al. | |
| 8,267,807 | B2 | 9/2012 | Takechi et al. | |
| 8,277,337 | B2 * | 10/2012 | Shimazaki | A63B 60/54 473/332 |
| 8,328,659 | B2 * | 12/2012 | Shear | A63B 60/00 473/332 |
| 8,911,302 | B1 * | 12/2014 | Ivanova | A63B 53/06 473/332 |
| 8,915,797 | B1 * | 12/2014 | Kuhar | A63B 53/0475 473/335 |
| 9,044,653 | B2 | 6/2015 | Wahl et al. | |
| 2002/0068645 | A1 | 6/2002 | Vincent et al. | |
| 2005/0096151 | A1 | 5/2005 | Hou et al. | |
| 2005/0227781 | A1 | 10/2005 | Huang et al. | |
| 2007/0281796 | A1 * | 12/2007 | Gilbert | A63B 53/04 473/332 |
| 2008/0318706 | A1 | 12/2008 | Larson | |
| 2010/0056297 | A1 * | 3/2010 | Roach | A63B 60/02 473/332 |
| 2011/0070970 | A1 | 3/2011 | Wan | |
| 2011/0159984 | A1 | 6/2011 | Shimazaki et al. | |
| 2012/0157222 | A1 | 6/2012 | Kii et al. | |

* cited by examiner

100

GOLF CLUB HEADS WITH SOLE CAVITY PORTS AND RELATED METHODS

CROSS-REFERENCE TO RELATED APPLICATIONS

This is a continuation of U.S. Non-Provisional application Ser. No. 16/548,676, filed on Aug. 22, 2019, which is a continuation of U.S. Non-Provisional application Ser. No. 15/887,094, filed on Feb. 2, 2018, now U.S. Pat. No. 10,413,792, which is a continuation of U.S. Non-Provisional application Ser. No. 15/209,425, filed Jul. 13, 2016, now U.S. Pat. No. 9,925,442, which is a continuation of U.S. Non-Provisional application Ser. No. 14/338,224, filed on Jul. 22, 2014, now U.S. Pat. No. 9,421,435, which claims the benefit of U.S. Provisional Patent Application No. 61/856,944, filed on Jul. 22, 2013, the contents of all of which is fully incorporated herein.

TECHNICAL FIELD

The present invention generally relates to golf equipment and, more particularly, to golf club heads.

BACKGROUND

Golf clubs and specifically golf club heads of various designs have typically been developed to improve a person's golf swing and resulting golf shot. In particular, many people are unable to hit or lack consistency when hitting "down" on a ball, that is, to regularly hit the ball squarely. Golf club designs and, particularly, golf club head designs may optimize a golf club head's impact on the golf ball, such that the golf club head can impart better flight characteristics to the golf ball, such as increased launch angle, increased speed, and/or decreased ball spin. Such designs may mitigate a person's inconsistency problems.

Figure 1:
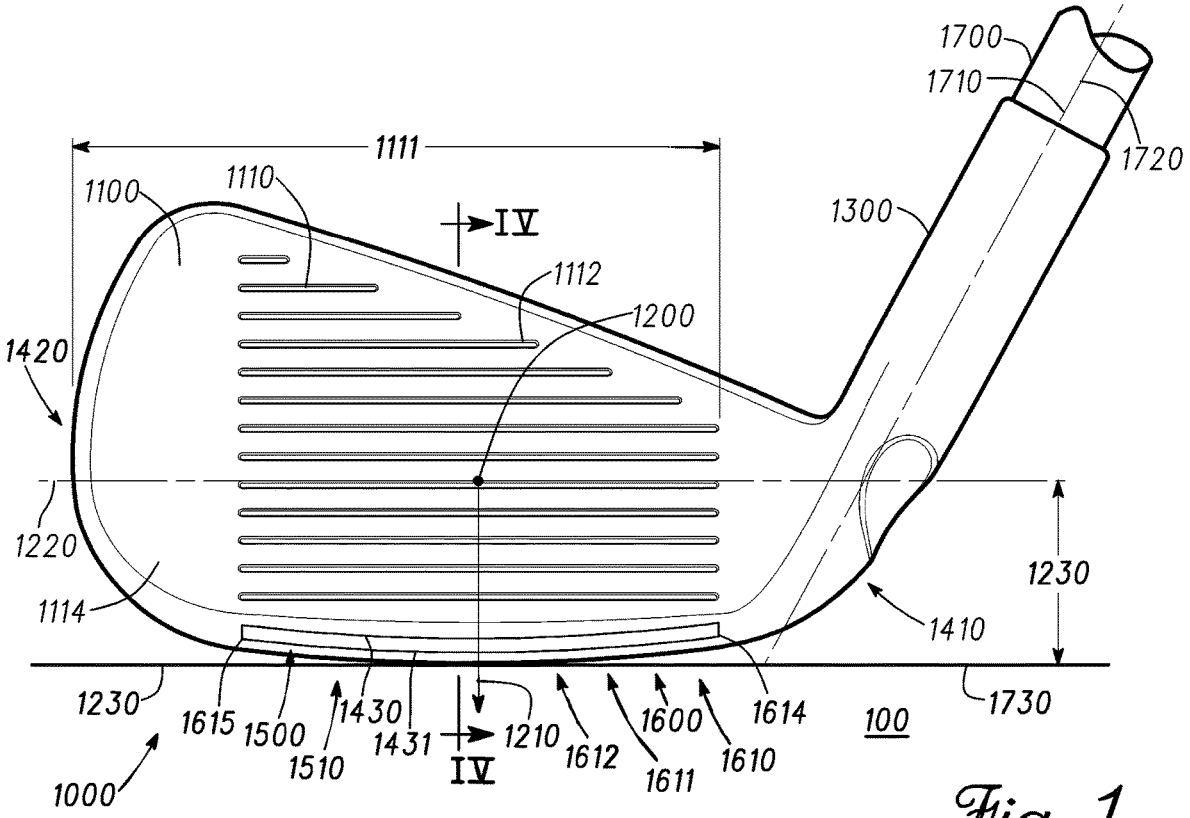
FIG. 1 illustrates a front address view of a golf club head of a golf club head system according to an embodiment.

For simplicity and clarity of illustration, the drawing figures illustrate the general manner of construction, and descriptions and details of well-known features and techniques may be omitted to avoid unnecessarily obscuring the invention. Additionally, elements in the drawing figures are not necessarily drawn to scale. For example, the dimensions of some of the elements in the figures may be exaggerated relative to other elements to help improve understanding of embodiments of the present invention. The same reference numerals in different figures denote the same elements.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Furthermore, the terms "include," and "have," and any variations thereof, are intended to cover a non-exclusive inclusion, such that a process, method, system, article, device, or apparatus that comprises a list of elements is not necessarily limited to those elements, but may include other elements not expressly listed or inherent to such process, method, system, article, device, or apparatus.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the invention described herein are, for example, capable of operation in other orientations than those illustrated or otherwise described herein.

The terms "couple," "coupled," "couples," "coupling," and the like should be broadly understood and refer to connecting two or more elements mechanically and/or otherwise. Two or more mechanical elements may be mechanically coupled together, but not be electrically or otherwise coupled together. Coupling may be for any length of time, e.g., permanent or semi permanent or only for an instant.

"Electrical coupling" and the like should be broadly understood and include coupling involving any electrical signal, whether a power signal, a data signal, and/or other types or combinations of electrical signals. "Mechanical coupling" and the like should be broadly understood and include mechanical coupling of all types.

The absence of the word "removably," "removable," and the like near the word "coupled," and the like does not mean that the coupling, etc. in question is or is not removable.

DESCRIPTION

In one embodiment of the golf club heads with sole cavity ports and related methods described herein, a system can comprise a first golf club head comprising a face comprising a strikeface and a backside opposite the strikeface, a head CG from which a gravity vector extends, a shaft axis extended along a shaft axis plane, a head heel portion, a head toe portion; and a sole coupled to the face and comprising a sole bottom side and a sole port structure having a port cavity extending into the sole from the sole bottom side. The system can further comprise a first weight insertable into the port cavity along a first insertion axis. Further, the sole port structure can comprise a cavity opening located at the sole bottom side for access to the port cavity, a cavity heel end at the head heel portion, a cavity toe end at the head toe portion, a cavity front wall toward the face and extended between the cavity heel end and the cavity toe end, and a cavity rear wall away from the face and extended between the cavity heel end and the cavity toe end. In addition, the first weight can be inserted into the port cavity via the cavity opening, and the weight can be abutted against the cavity front wall and against the cavity rear wall. When the first golf club head is at address, with the shaft axis plane parallel to the gravity vector and orthogonal to a ground plane, the port cavity can comprise a cavity length, measured parallel to the ground plane from the cavity heel end to the cavity toe end; the strikeface can comprise a strikeface length; and the cavity length can be approximately 30% to approximately 90% of the strikeface length.

There can be examples in accordance with the present disclosure where the port cavity can comprise a cavity length, measured parallel to the ground plane from the cavity heel end to the cavity toe end, a cavity height, measured parallel to the first insertion axis between the cavity opening and a cavity inner end opposite the cavity opening, a cavity center section centered relative to the cavity length, and extending throughout approximately 75% of the cavity length, and a cavity thickness, measured orthogonal to the first insertion axis along a maximum distance between the cavity front wall and the cavity rear wall within the cavity center section. Further, in some embodiments the cavity length can be at least 15 times greater than the cavity thickness.

Other embodiments can include a method comprising providing a first golf club head comprising a face comprising a strikeface and a backside opposite the strikeface, a head CG from which a gravity vector extends, a shaft axis extended along a shaft axis plane, a head heel portion, a head toe portion, and a sole coupled to the face and comprising a sole bottom side and a sole port structure having a port cavity extending into the sole from the sole bottom side. Some embodiments can further include a method comprising providing a first weight insertable into the port cavity along a first insertion axis, wherein the sole port structure comprises a cavity opening located at the sole bottom side for access to the port cavity, a cavity heel end at the head heel portion, a cavity toe end at the head toe portion, a cavity front wall toward the face and extended between the cavity heel end and the cavity toe end, and a cavity rear wall away from the face and extended between the cavity heel and the cavity toe end. When the first weight is inserted into the port cavity via the cavity opening, the weight can be abutted against the cavity front wall. In some embodiments, the weight can also be abutted against the cavity rear wall. The port cavity can comprise a cavity length measured parallel to the ground plane from the cavity heel end to the cavity toe end, the strikeface can comprise a strikeface length, and the cavity length can be approximately 30% to approximately 90% of the strikeface length.

In one embodiment of the golf club heads with sole cavity ports and related methods described herein, an apparatus can comprise a first golf club head comprising a face comprising a strikeface and a backside opposite the strikeface, a head CG from which a gravity vector extends, a shaft axis extended along a shaft axis plane, a head heel portion, a head toe portion, and a sole coupled to the face and comprising a sole bottom side and sole port structure having a port cavity extending into the sole from the sole bottom side and a first weight insertable into the port cavity along a first insertion axis. In addition, in some embodiments the sole port structure comprises a cavity opening located at the sole bottom side for access to the port cavity, a cavity heel end at the head heel portion, a cavity toe end at the head toe portion, a cavity front wall toward the face and extended between the cavity heel end and the cavity toe end, and a cavity rear wall away from the face and extended between the cavity heel end and the cavity toe end. When the first weight is inserted into the port cavity via the cavity opening, the weight can be abutted against the cavity front wall. In addition, the weight can also be abutted against the cavity rear wall. When the first golf club head is at address, with the shaft axis plane parallel to the gravity vector and orthogonal to a ground plane, the port cavity comprises a cavity length measured parallel to the ground plane from the cavity heel end to the cavity toe end, the strikeface comprises a strikeface length, and the cavity length can be approximately 30% to approximately 90% of the strikeface length.

Examples and embodiments are further disclosed herein. Such examples and embodiments may be found in the figures, in the claims, and/or in the present description.

Figure 2:
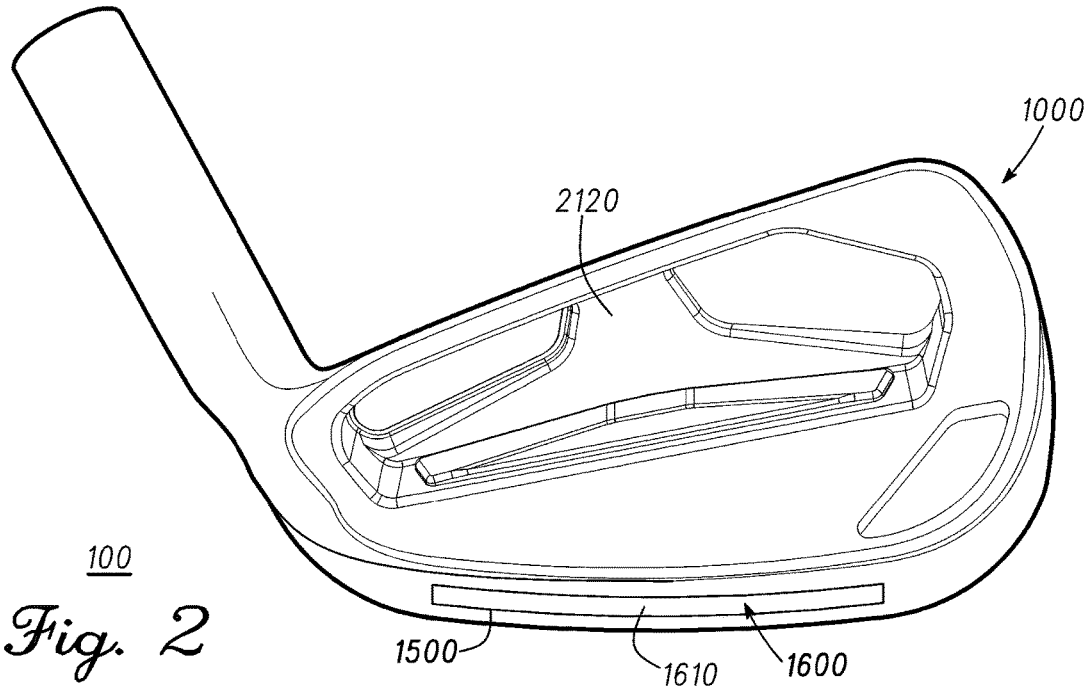
FIG. 2 illustrates a rear view of the golf club head of FIG. 1.
Figure 3:
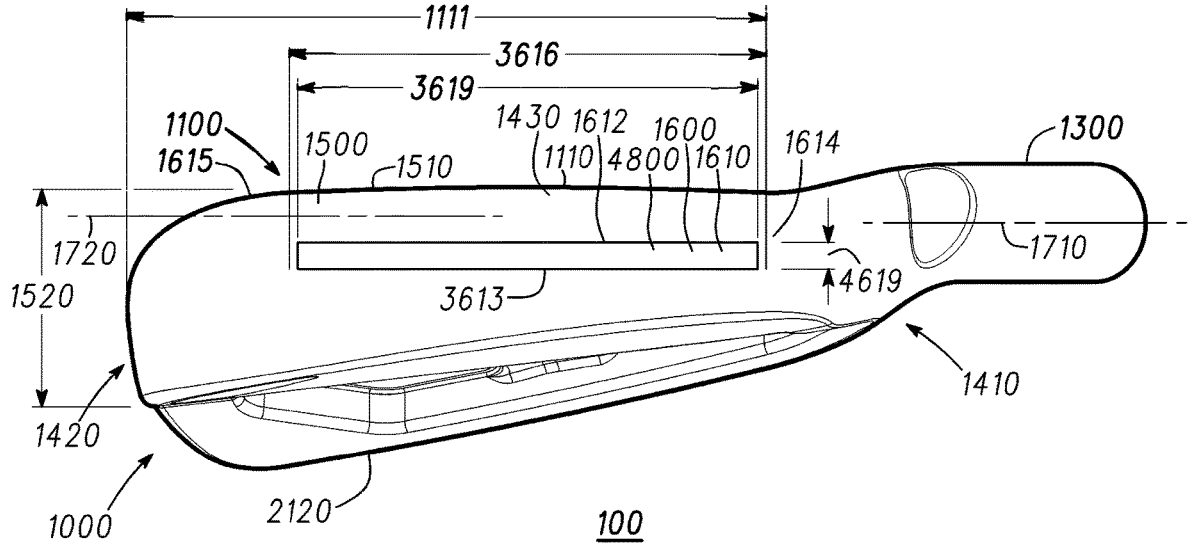
FIG. 3 illustrates a bottom view of the golf club head of FIG. 1.
Figure 4:
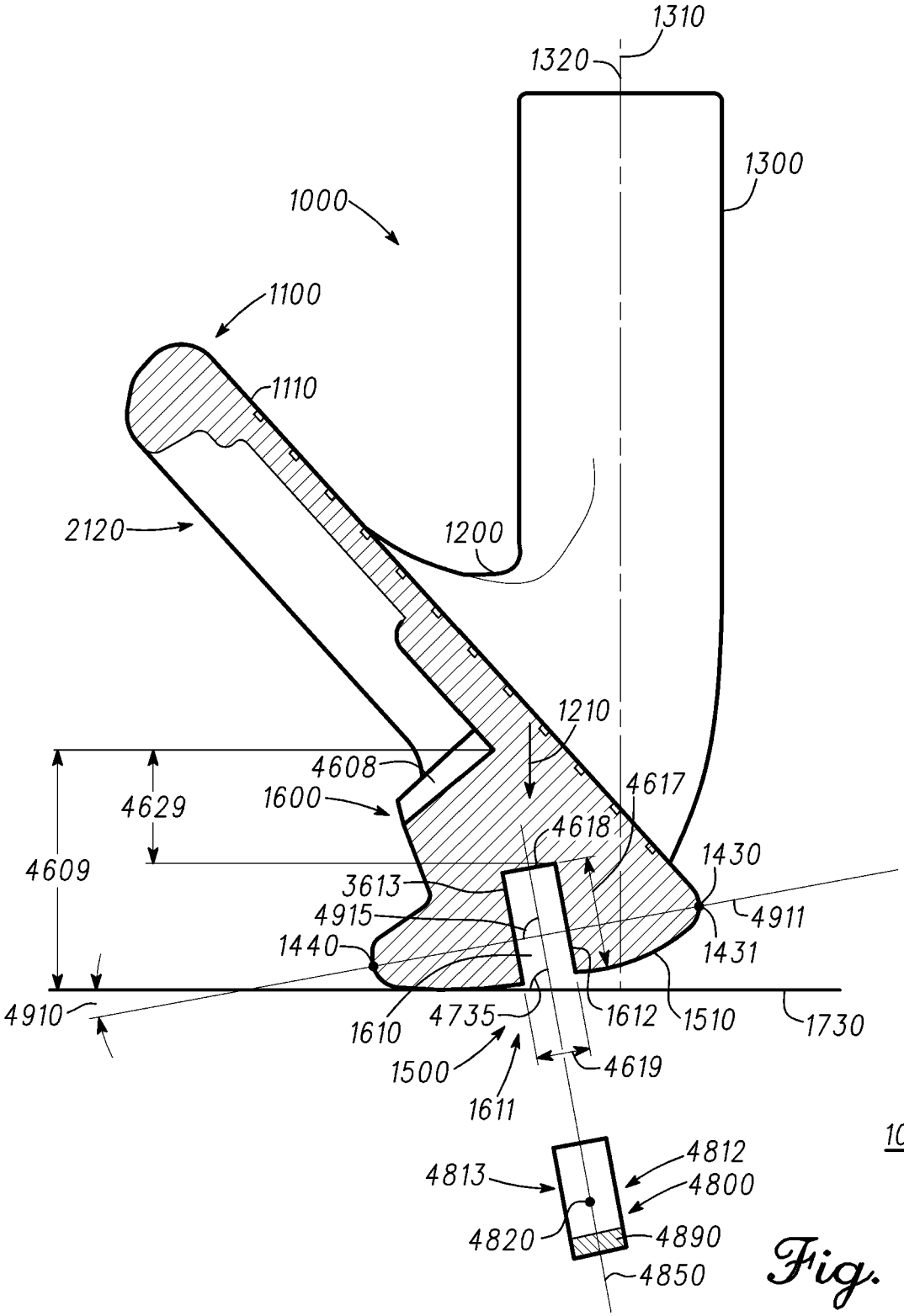
FIG. 4 illustrates an exploded side cross-sectional view of the golf club head of FIG. 1 at address, and of a weight member thereof with respect to line IV-IV of FIG. 1.

FIG. 1 illustrates a front address view of golf club head 1000 of golf club head system 100. FIG. 2 illustrates a rear view of golf club head 1000. FIG. 3 illustrates a bottom view of golf club head 1000. FIG. 4 illustrates an exploded side address cross-sectional view of golf club head 1000 and weight member 4800 with respect to line IV-IV of FIG. 1.

Golf club head 1000 comprises face 1100, head center of gravity (CG) 1200, hosel 1300, head heel portion 1410, head toe portion 1420, and sole 1500 coupled to face 1100. Sole 1500 comprises sole bottom 1510 and sole port structure 1600, where sole port structure 1600 comprises port cavity 1610 extending into sole 1500 from sole bottom 1510. Golf club head 1000 also comprises shaft axis 1710, which in the present example traverses along a centerline of hosel 1300 and corresponds to a centerline of shaft 1700 attachable to hosel 1300.

FIGS. 1, 3, and 4 illustrate golf club head 1000 at address over ground plane 1730. Shaft axis 1710 of golf club head 1000 extends through shaft axis plane 1720, which is coplanar with the illustration of FIG. 1 and orthogonal to the illustration of FIG. 4. As defined herein, when golf club head 1000 is at address, ground plane 1730 is orthogonal to gravity vector 1210, shaft axis plane 1720 is parallel to gravity vector 1210, and shaft axis plane 1720 is orthogonal to ground plane 1730. In addition, when golf club head 1000 is at address, grooves 1112 of strikeface 1110 can be parallel to ground plane 1730.

Head center of gravity (CG) 1200 is defined by a combined mass of golf club head 1000 and weight member 4800 when inserted in port cavity 1610 of sole port structure 1600. Gravity vector 1210 extends from head CG 1200 as dictated by the force of gravity acting upon golf club head 1000 with respect to head CG 1200 when golf club head 1000 is at address. Line IV-IV in FIG. 1 extends through head CG 1200.

Figure 5:
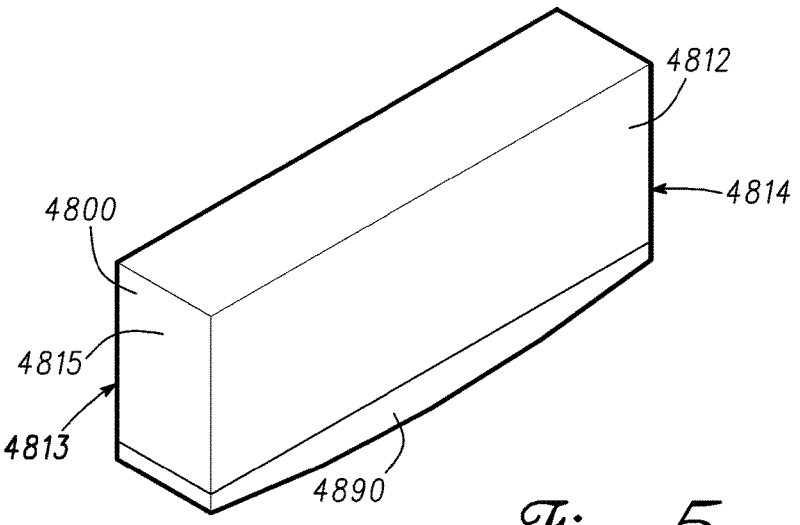
FIG. 5 illustrates a perspective view of the weight member of FIG. 4.
Figure 7:
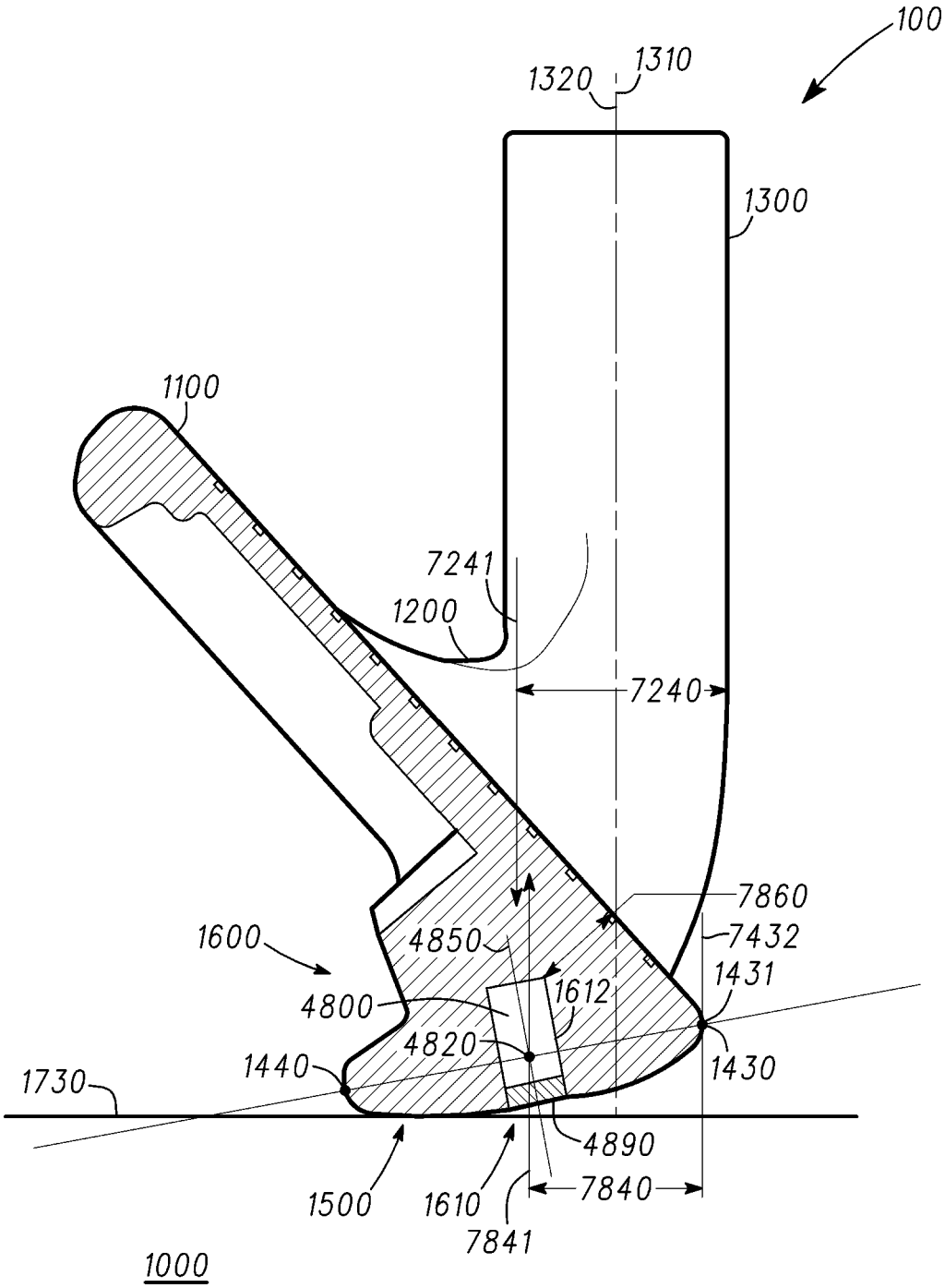
FIG. 7 illustrates a side cross-sectional view of the golf club head of FIG. 1 at address, with the weight member in a port cavity thereof, and with respect to line IV-W of FIG. 1.

FIG. 5 illustrates a perspective view of weight member 4800 of System 100, which as seen in FIG. 4 is insertable into port cavity 1610 along insertion axis 4850 to adjust one or more characteristics of golf club head 1000. In the present example, weight cap 4890 is coupled to the bottom of weight member 4800 and, as seen in FIG. 7, faces an exterior of sole 1500 of golf club head 1000 when weight member 4800 is inserted in port cavity 1610. In some examples, weight cap 4890 can be substantially flush with sole 1500, and/or can substantially match the contour of the bottom end of sole 1500, but there can be other examples where weight cap 4890 can be recessed relative to the bottom surface of sole 1500. Weight cap 4890 can comprise a material, such as an elastomer material or a metallic material, which can be different than the material of weight member 4800. For instance, the material of weight cap 4890 can be denser than the material of weight member 4800 and/or denser than the material of sole 1500. There can be examples, however, where weight cap 4890 can be integral as a single piece with weight member 4800 and/or may comprise the same material as weight member 4800. Weight cap 4890 is optional, however, and thus there can be embodiments without weight cap 4890.

As seen in FIG. 4, sole port structure 1600 is located within sole 1500 rather than above it, thus permitting weight member 4800 to be located low relative to golf club head 1000, and thus permitting the length of weight member 4800 and cavity length 3616 to extend along a larger heel-toe distance (FIGS. 2, 3, 6) to enhance moment of inertia (MOI) characteristics. In addition, accounting for the larger length of weight member 4800 described above, a thickness of weight 4800 can thus be narrowed for better transfer of vibrational energy.

In the present embodiment, sole port structure 1600 comprises cavity opening 1611 located at sole bottom 1510 for access to port cavity 1610. Cavity heel end 1614 is located at head heel portion 1410, while cavity toe end 1615 is located at head toe portion 1420 of golf club head 1000. Cavity front wall 1612 is located towards face 1100 and extends between cavity heel end 1614 and cavity toe end 1615. Cavity rear wall 3613 is away from face 1100, and also extends between cavity heel end 1614 and cavity toe end 1615. Correspondingly, weight 4800 comprises weight heel end 4814, weight toe end 4815, weight front wall 4812 extended between weight heel end 4814 and weight toe end 4815, and weight rear wall 4813 extended between weight heel end 4814 and weight toe end 4815. When weight member 4800 is inserted into port cavity 1610 via cavity opening 1611, weight heel end 4814 is located at head heel portion 1410 proximate to cavity heel end 1614, weight toe end 4815 is located at head toe portion 1420 proximate to cavity toe end 1615, weight front wall 4812 is abutted against cavity front wall 1612, and weight rear wall 4813 is abutted against cavity rear wall 1613.

The configuration of sole port structure 1600 is configured to place weight member 4800 low and directly opposite strikeface 1110 along a region that would otherwise be occupied by the metallic material of sole 1500, thus permitting better transfer of vibrational energy therethrough for increased sensitivity for the user, and thus liberating sole material that can be redistributed elsewhere. For example, such liberated sole material can be relocated towards the rear of golf club head 1000, thereby displacing head CG 1200 away from strikeface 1110, and thus increasing MOI about heel-toe axis 1220 at impact with a golf ball. In the present example, heel-toe axis 1220 intersects head CG 1200 parallel to shaft axis plane 1720 and parallel to ground plane 1730 when golf club head 1000 is at address.

In the present example, weight member 4800 can comprise one or more materials, such as a thermoplastic elastomer (TPE) and/or a thermoplastic polyurethane (TPU), and/or can comprise a density of approximately 1 gram per centimeters cubed (gram/cm$^3$) to approximately 9 g/cm$^3$. Sole 1500 can comprise a metallic material such as steel, titanium, and/or alloys thereof, and/or can comprise a density of approximately 4 gram/cm$^3$ to approximately 8 gram/cm$^3$. The material of weight member 4800 can thus be softer, more flexible, and/or lighter than the material of sole 1500, and in some examples can permit increased deflection of face 1100, via bending or compression of sole port structure 1600 along cavity front wall 1612 of port cavity 1610, for improved dispersion and/or forgiveness upon impact of a golf ball by strikeface 1110.

As seen in FIG. 3, port cavity 1610 comprises cavity length 3616 which is measured, from cavity heel end 1614 to cavity toe end 1615, and parallel to ground plane 1730 when golf club head 1000 is at address. Port cavity 1610 further comprises cavity center section 3619, which is centered relative to cavity length 3616 and extends throughout 75 percent (%) of cavity length 3616. As seen in FIG. 4, port cavity 1610 also comprises cavity height 4617 which is measured, parallel to insertion axis 4850, from cavity opening 1611 to cavity inner end 4618 opposite cavity opening 1611. In some examples, cavity height 4617 can be approximately 2 millimeters (mm) to approximately 18 mm. Cavity thickness 4619 of port cavity 1610 is measured orthogonal to insertion axis 4850 and comprises a maximum distance, within cavity center section 3619, between cavity front wall 1612 and cavity rear wall 3613. In some examples, cavity thickness 4619 can be approximately 2 mm to approximately 10 mm and cavity length 3616 can be at least 15 times greater than cavity thickness 4619. Furthermore, cavity length 3616 can be at least 3 times greater than cavity height 4617 in the same or other examples. As seen in FIG. 3, sole 1500 comprises sole maximum thickness 1520 measured orthogonal to shaft axis plane 1720, and there can be examples where cavity thickness 4619 can be approximately 8% to approximately 50% of maximum sole thickness 1520.

Golf club head 1000 comprises strikeface length 1111 as seen in FIGS. 1 and 3, where cavity length 3616 (FIG. 3) is configured to be approximately 70% to 80% of strikeface length 1111 in the present example. Cavity length 3616 is measured in the present embodiment from heel end to toe end of the portion of strikeface 1110 that is substantially flat, thus not including the curved transition portion between hosel 1300 and strikeface 1110. In the same or other examples, cavity length 3616 can be measured from the heelmost end of grooves 1112 of strikeface 1110. There can be examples where cavity length 3616 can be approximately 30% to approximately 90% of strikeface length 1111.

Figure 6:
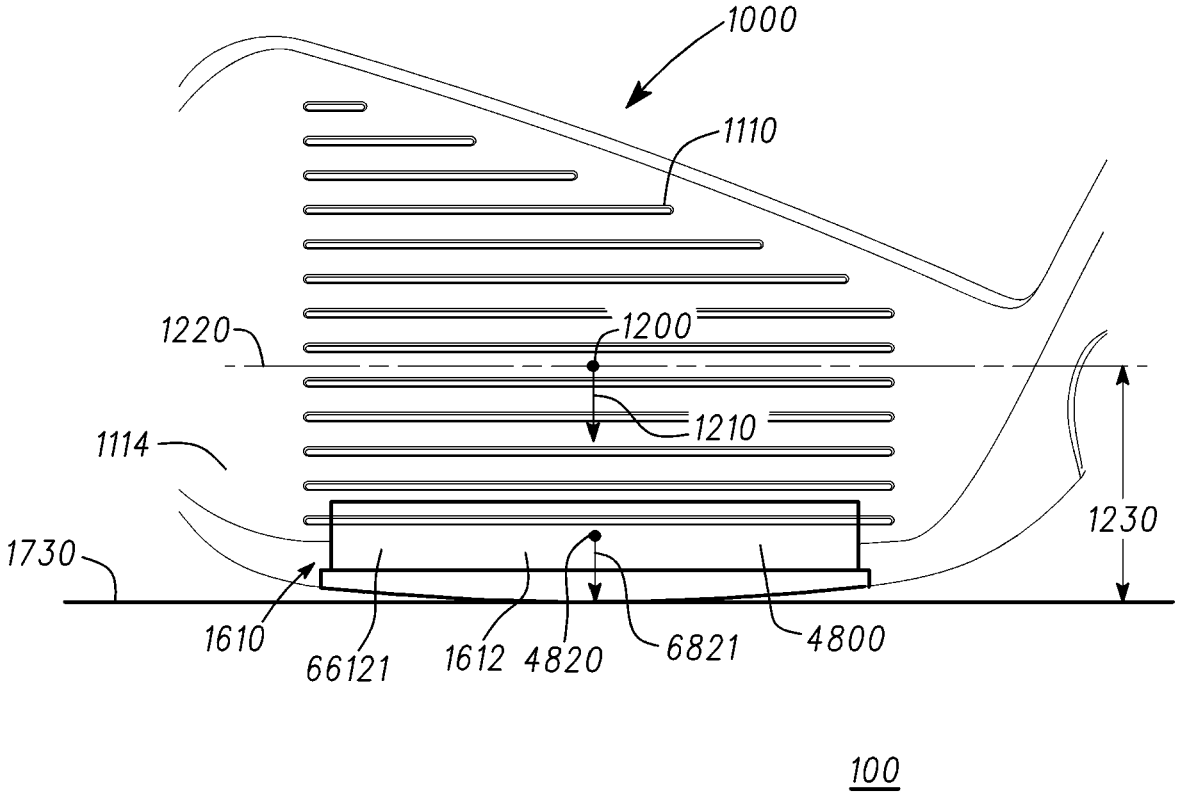
FIG. 6 illustrates an X-ray front view of the golf club head of FIG. 1 at address.

FIG. 6 illustrates an X-ray front view of golf club head 1000 at address, where cavity front wall 1612 of port cavity 1610 can be seen through strikeface 1110. Strikeface 1110 comprises lower strikeface area 1114 defined, when golf club head 1000 is at address, by the portion of strikeface 1110 located lower than head CG 1200 relative to ground pane 1730. Lengthwise, lower strikeface area 1114 can be defined with respect to strikeface length 1111.

Due to the increased cavity length 3616 and narrowed thickness of port cavity 1610, cavity front wall 1612 can present a larger area behind strikeface 1110 for better MOI attributes, better impact stress absorption, and/or vibrational transfer characteristics. In some examples, with golf club head 1000 at address such as seen in FIGS. 4 and 6, port cavity 1610 can be located fully below head CG 1200. In the same or other examples, cavity front wall area 66121 of cavity front wall 1612 can be approximately 250 millimeters squared (mm$^2$) to approximately 400 mm$^2$. Furthermore, in the same or other examples, cavity front wall area 66121 of cavity front wall 1612 can be at least approximately 30% of lower strikeface area 1112.

As seen in FIG. 4, sole port structure 1600 comprises port structure top end 4608 at an exterior of sole port structure 1600 and opposite cavity opening 1611. In some embodiments, port top end distance 4609, measured from port structure top end 4608 to ground plane 1730 and parallel to gravity vector 1210 when golf club head 1000 is at address, can be approximately 5 mm to approximately 20 mm. In the same or other embodiments, port top thickness 4629, measured from port structure top end 4608 to cavity inner end 4618 and parallel to ground plane 1730 when golf club head 1000 is at address, can be approximately 0 mm to approximately 5 mm.

Considering the above, due to the integration of port structure 1600 with sole 1500, port top thickness 4629 can be reduced or minimized. Furthermore, again due to the integration of port structure 1600 with sole 1500, golf club head 1000 can be devoid of a weight-securing rib that could otherwise be required to extend above port structure top end 4608, from head heel portion 1410 to head toe portion 1420 and along backside 2120 of face 1100, for securing a weight member above sole 1500. Such features can be beneficial, for example, to permit reduction or redistribution of material, to lower the height of head CG 1200, and/or to adjust MOI characteristics of golf club head 1000 as desired.

As seen in FIG. 6, when golf club head 1000 is at address, head CG 1200 is located at head CG height 1230 measured from head CG 1200 to ground plane 1730 and parallel to gravity vector 1210. In addition, weight member 4800 comprises weight CG 4820, and weight CG height 6821 measured from weight CG 4820 to ground plane 1730 and parallel to gravity vector 1210. In some embodiments, head CG height 1230 can be approximately 10 mm to approximately 30 mm. In the same or other embodiments, a difference between head CG height 1230 and weight CG height 6821 can be approximately 5 mm to approximately 20 mm.

FIG. 7 illustrates a side cross-sectional view of golf club head 1000 at address, with weight member 4800 in port cavity 1610, with respect to line IV-IV of FIG. 1. Golf club head 1000 comprises leading edgepoint 1431 at a frontmost end of leading edge 1430 of strikeface 1110, where face leading plane 7432 intersects leading edgepoint 1430 parallel to shaft angle plane 1320. Head CG vertical plane 7241 intersects head CG 1200 parallel to shaft angle plane 1320. Head CG 1200 is located at head CG depth 7240, which is measured, orthogonal to shaft axis plane 1320, from face leading plane 7432 to head CG vertical plane 7241. Weight CG 4820 is located at weight CG depth 7840, and is intersected by weight CG vertical plane 7841, which is parallel to shaft angle plane 1320. Weight CG depth 7840 is measured orthogonal to shaft axis plane 1320 at a minimum distance from face leading plane 7432 to weight CG vertical plane 7841, and can comprise approximately 4 mm to approximately 12 mm in some embodiments. In the same or other embodiments, a difference between head CG depth 7240 and weight CG depth 7840 can be approximately −10 mm to approximately 10 mm. Accordingly, the configuration of port structure 1600 can permit weight member 4800 and port cavity 1610 to be located lower and closer to face 1100 for better exposure to impact stresses, greater deflection of face 1100 at impact with a golf ball, and increased displacement of denser sole mass towards a rear of golf club head 1000 for better MOI characteristics. In some examples, cavity front wall depth 7860 can be measured orthogonal to strikeface 1110 at a minimum distance from strikeface 1110 to cavity front wall 1612, and can comprise approximately 2 mm to approximately 15 mm.

Figure 8:
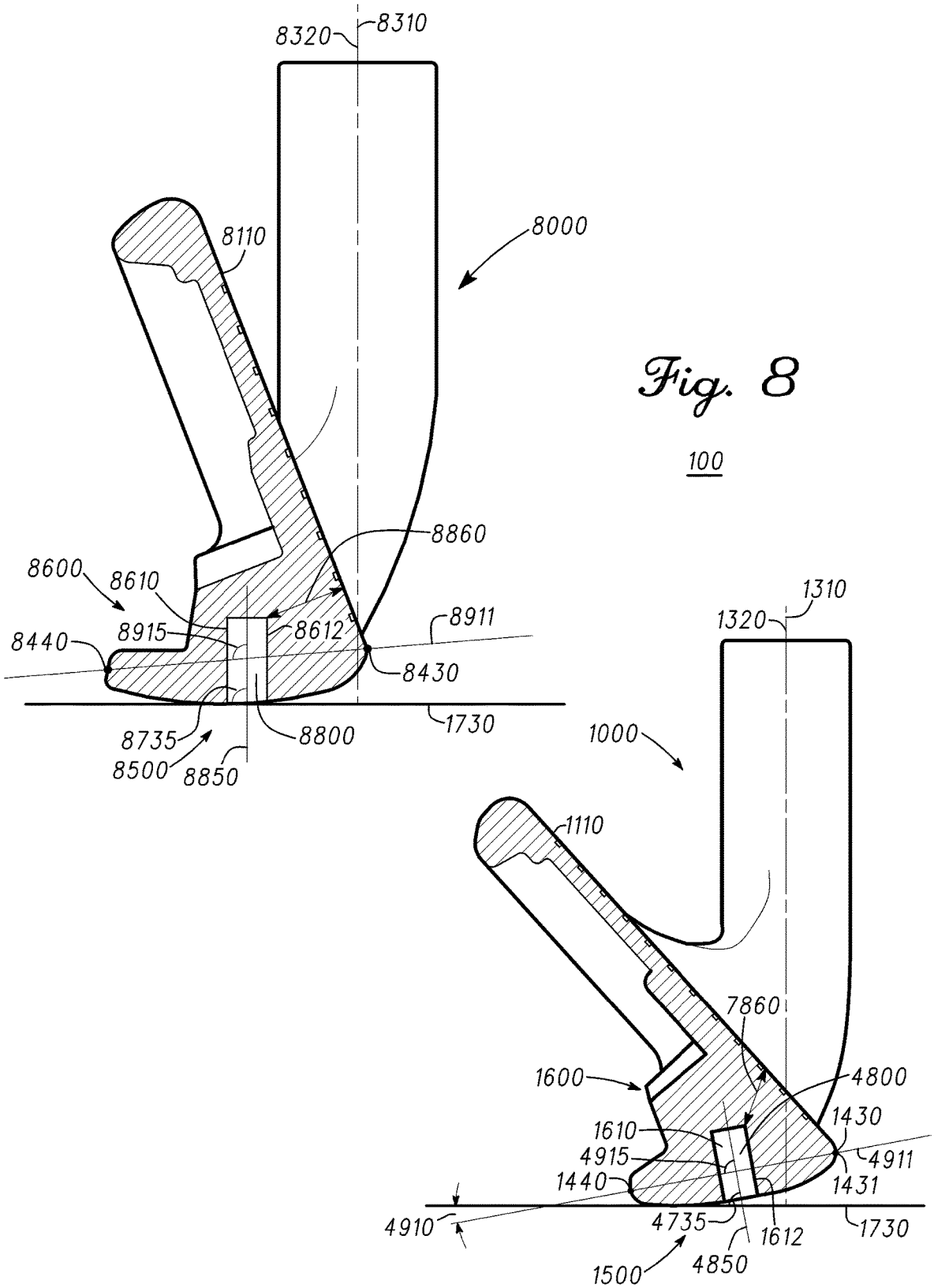
FIG. 8 illustrates a side cross-sectional view of a portion of the golf club system, showing the golf club head of FIG. 1 and another golf club head lined-up with respect to their respective shaft axes.

FIG. 8 illustrates a side cross-sectional view of system 100, showing golf club head 1000 and golf club head 8000 thereof lined-up with respect to their respective shaft axes 1310 and 8310. Golf club head 8000 is similar to golf club head 1000, but comprises a long-type golf club head with a lower loft angle than golf club head 1000, which comprises a short-type golf club head with a greater loft angle. In some examples, short-type golf club heads can comprise iron-type golf club heads numerically higher than a 7-iron, such as 8-irons, 9-irons, or and/or wedge-type iron heads. In the same or other examples, long-type golf club heads can comprise iron-type golf club heads numerically lower than a 5-iron, such as 1-irons, 2-irons, 3-irons, or 4-irons. In such examples, mid-type golf club heads can comprise 5-irons and 6-irons. In the exemplary embodiment of system 100 shown in FIG. 8, golf club head 1000 comprises short-type golf club head with a loft angle of approximately 35 degrees to approximately 65 degrees, while golf club head 8000 comprises a long-type golf club head with a loft angle of approximately 18 degrees to approximately 25 degrees. For instance, golf club head 1000 can comprise a 9-iron with a loft angle of, for example, approximately 38 degrees to 42 degrees, while golf club head 8000 can comprise a 3-iron with a loft angle of, for example, approximately 18 degrees to approximately 22 degrees.

Golf club head 8000 comprises sole 8500 having port structure 8600 with port cavity 8610 extending into sole 8500 and into which weight member 8800 is inserted along insertion axis 8850, and is thus similar in arrangement with respect to sole 1500 and port structure 1600 of golf club head 1000. Both golf club heads 1000 and 8000 are shown in FIG. 8 at address over ground plane 1730 in accordance with the description given above.

As seen in FIG. 8, golf club head 1000 comprises bounce angle 4910 measured between ground plane 1730 and bounce angle axis 4911, where bounce angle axis 4911 extends, from leading edge 1430 to trailing edge 1440, orthogonal to leading edge 1430. Port cavity 1610 comprises cavity-bounce angle 4915 measured between insertion axis 4850 and bounce axis 4911. Port cavity 1610 also comprises cavity-ground angle 4735 measured between insertion axis 4850 and ground plane 1730. Similarly, golf club head 8000 in FIG. 8 comprises bounce angle 8910 measured between ground plane 1730 and bounce angle axis 8911, where bounce angle axis 8911 extends, from leading edge 1430 to trailing edge 8440, orthogonal to leading edge 8430. Port cavity 8610 comprises cavity-bounce angle 8915 measured between insertion axis 8850 and bounce axis 8911. Port cavity 1610 also comprises cavity-ground angle 8735 measured between insertion axis 8850 and ground plane 1730. Bounce angle 4910 of golf club head 1000 is greater than bounce angle 8910 of golf club head 8000 in the present example. Cavity-bounce angle 4915 of golf club head 1000 can be approximately 70 degrees to approximately 110 degrees, but is substantially orthogonal to bounce angle axis 4911 in the present example. Similarly, cavity-bounce angle 8915 of golf club head 8000 can be approximately 70 degrees to approximately 110 degrees, but is substantially orthogonal to bounce angle axis 8911 in the present example.

Notwithstanding the similarities between the cavity-bounce angles of the golf club heads of system 100 as described above, as can be seen by comparing port cavity 1610 of golf club head 1000 against port cavity 8610 of golf club head 8000, the golf club heads of system 1000 are configured so that their respective port cavities progressively tilt from club head to club head. For instance, relative to ground plane 1730, cavity-ground angle 8735 of port cavity 8610 for golf club head 8000 is greater than cavity-ground angle 4735 of port cavity 1610 for golf club head 1000. Cavity-ground angle 4735 for port cavity 1610 of golf club head 1000 can be approximately 60 degrees to approximately 100 degrees, and is approximately 80 degrees in the present example.

Cavity-ground angle 8735 for port cavity 8610 of golf club head 8000 can be approximately 66 degrees to approximately 106 degrees, and is approximately 86 degrees in the present example. Accordingly, for the golf club heads of system 100, long-type golf club heads have cavity-ground angles that are greater than the cavity-ground angles of short-type golf club heads. In some implementations, the cavity-ground angles of the port cavities of the golf club heads of system 100 can be configured to decrease, club head to club head, for each loft angle increase. In addition, as can be seen in FIG. 8, insertion axis 4850 for golf club head 1000 is non-parallel to strikeface 1110 and non-orthogonal to ground plane 1730 when golf club head 1000 is at address. In some implementations, the insertion axis for each port cavity of each golf club of system 100 can be configured to be non-parallel to their respective strikeface, and non-orthogonal to ground plane 1730 when its respective golf club head is at address.

As previously described, and as seen in FIGS. 7 and 8, port cavity 1610 of golf club head 1000 comprises cavity front wall depth 7860. Similarly, port cavity 8610 of golf club head 8000 in FIG. 8 comprises cavity front wall 8612 towards strikeface 8110, and also comprises cavity front wall depth measured orthogonal to strikeface 8110 at a minimum distance from strikeface 8110 to cavity front wall 8612. In the present embodiment of system 100, cavity front wall depth 7860 in golf club head 1000 can be approximately 5 mm to approximately 13 mm, while cavity front wall depth 8860 in golf club head 1000 can be approximately 3 mm to approximately 11 mm. Accordingly, cavity front wall depth 7860 can be greater than cavity front wall depth 8860. In some implementations, the cavity front wall depth for the port cavities of the golf club heads of system 100 can be configured to increase, club head to club head, for each loft angle increase. Accordingly, for the golf club heads of system 100, short-type golf club heads like golf club head 1000 have corresponding cavity front wall depths greater than the cavity front wall depths of long-type golf club heads like golf club head 8000. Such an arrangement can place the port cavities and weight members of long-type golf club heads closer to their respective strikefaces than the port cavities and weight members of short-type golf club heads with respect to their respective strikefaces.

In some implementations, the weight members of the golf club heads of system 100 can comprise a mass of approximately 2 grams to approximately 28 grams. The weight members can also vary depending on their respective golf club head, such as for adjusting the swingweights of the golf club heads throughout the set of system 100. In the same or other implementations, the mass of the weight members can be configured to increase or decrease from golf club to golf club throughout the set of golf clubs. For example, the short-type golf club heads can have weight members with a greater mass than the long-type heads, and/or the mass of the weight members can increase as loft angle increases. In the present embodiment of FIG. 8, weight element 4800 of short-type golf club head 1000 comprises a mass of approximately 12 grams to approximately 28 grams, while weight element 8800 of long-type golf club head 8000 comprises a mass of approximately 2 grams to approximately 12 grams. Mid-type golf club heads of system 100 can comprise a weight member similar to weight member 4800 but with a mass of approximately 8 grams to approximately 18 grams. There can be examples, however, where the mass of the weight members need not change and/or may be substantially constant throughout the set. Weight members can also be configured to be interchangeable between the different golf club heads of system 1000. For example, weight member 8800 can be insertable into port cavity 1610 of golf club head 1000, and/or weight member 4800 can be insertable into port cavity 8610 of golf club head 8000. Accordingly, the dimensions of weight members 4800 and 8800 can be substantially similar to each other even if their masses can differ from each other.

Figure 9:
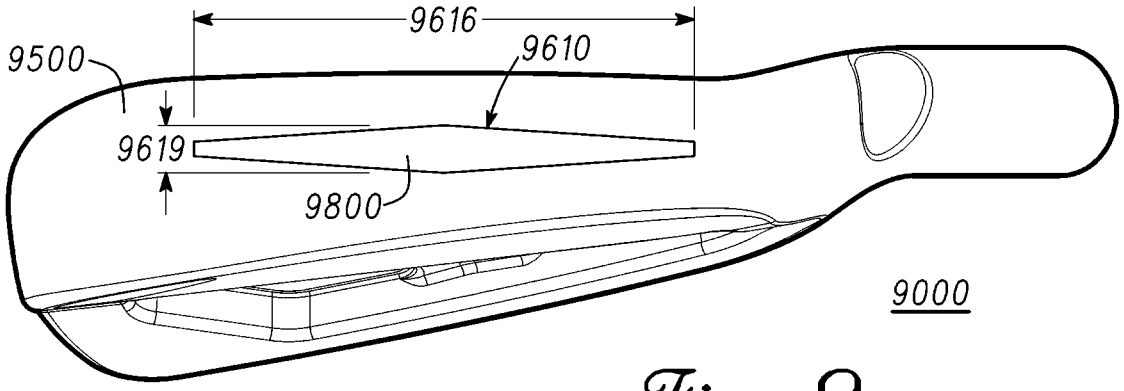
FIG. 9 illustrates a bottom view of a golf club head according to another embodiment.

FIG. 9 illustrates a bottom view of golf club head 9000, which can be similar to golf club head 1000 (FIGS. 1-8), but instead comprises port cavity 9610 and weight member 9800 with corresponding dimensions therebetween. In the present example, port cavity 9610 comprises cavity thickness 9619, which varies along cavity length 9616 so that cavity thickness 9619 is greater towards the center of cavity length 9616 and narrower towards the heel and toe ends of port cavity 9610. Port cavity 9610 and weight member 9800 can be otherwise similar to port cavity 1610 (FIG. 1-4, 6-8) and weight member 4800 (FIGS. 4-8), respectively. In some examples, such as where the material of sole 9500 is denser or more rigid than the material of weight member 9800, the configuration of port cavity 9610 and weight member 9800 can increase face deflection towards the center of cavity length 9616, and/or can increase MOI about the center of cavity length 9616 with respect to the heel and toe ends of golf club head 9000.

Figure 10:
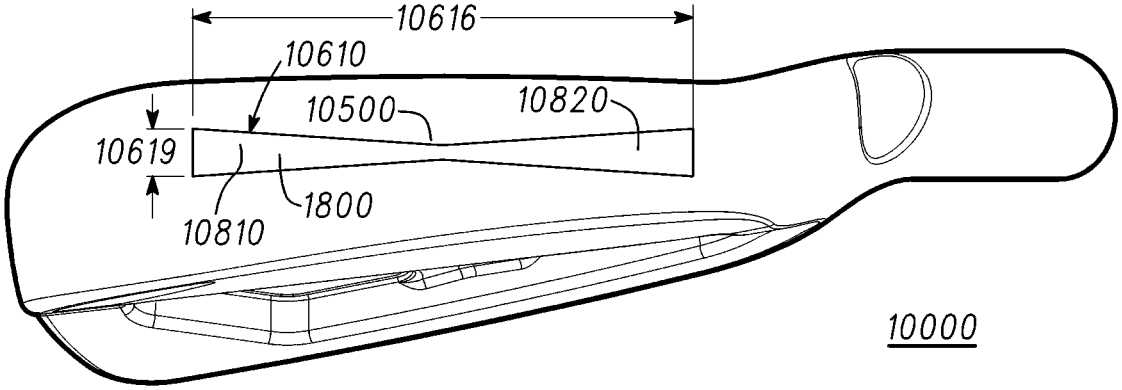
FIG. 10 illustrates a bottom view of a golf club head according to a further embodiment.

FIG. 10 illustrates a bottom view of golf club head 10000, which can be similar to golf club head 1000 (FIGS. 1-8), but instead comprises port cavity 10610 and weight member 10800 with corresponding dimensions therebetween. In the present example, port cavity 10610 comprises cavity thickness 10619, which varies along cavity length 10616 so that cavity thickness 10619 is greater towards the heel and toe ends of port cavity 10610 and narrower towards center of cavity length 10616. Port cavity 10610 and weight member 10800 can be otherwise similar to port cavity 1610 (FIG. 1-4, 6-8) and weight member 4800 (FIGS. 4-8), respectively. In some examples, the density of the material of weight member 10800 can vary along cavity length 10616, such that the mass of weight heel portion 10820 can be greater than the mass of weight toe portion 10810, or vice-versa. Such an arrangement can be useful for adjusting golf club head 10000 to be draw-biased or fade-biased depending on the needs of a particular user.

Figure 11:
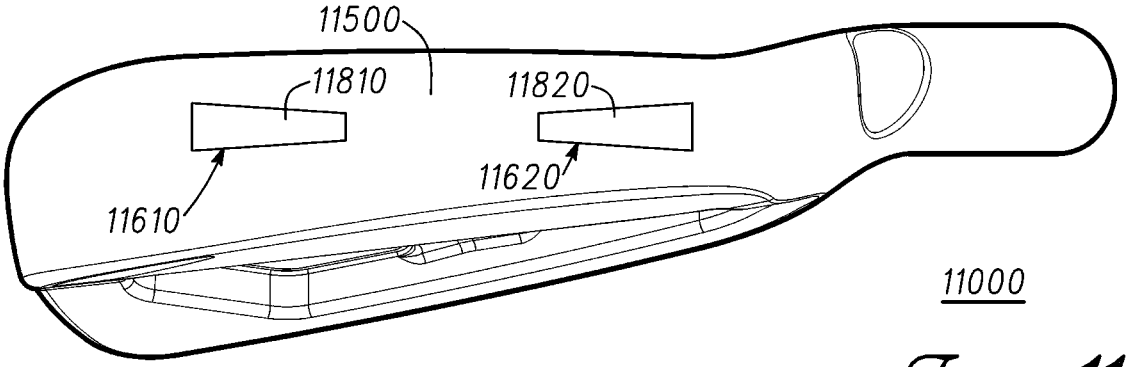
FIG. 11 illustrates a bottom view of a golf club head according to another embodiment.

FIG. 11 illustrates a bottom view of golf club head 11000, which can be similar to golf club head 1000 (FIGS. 1-8), but instead comprises two separate cavities and weights, namely, toe port cavity 11610 with toe weight member 11810, and heel port cavity 11620 with heel weight member 11820. In some examples, the density of the material of heel weight member 11820 can be greater than the density of the material of toe weight member 11810, or vice-versa. Such an arrangement can also be useful for adjusting golf club head 11000 to be draw-biased or fade-biased depending on the needs of a particular user.

Figure 12:
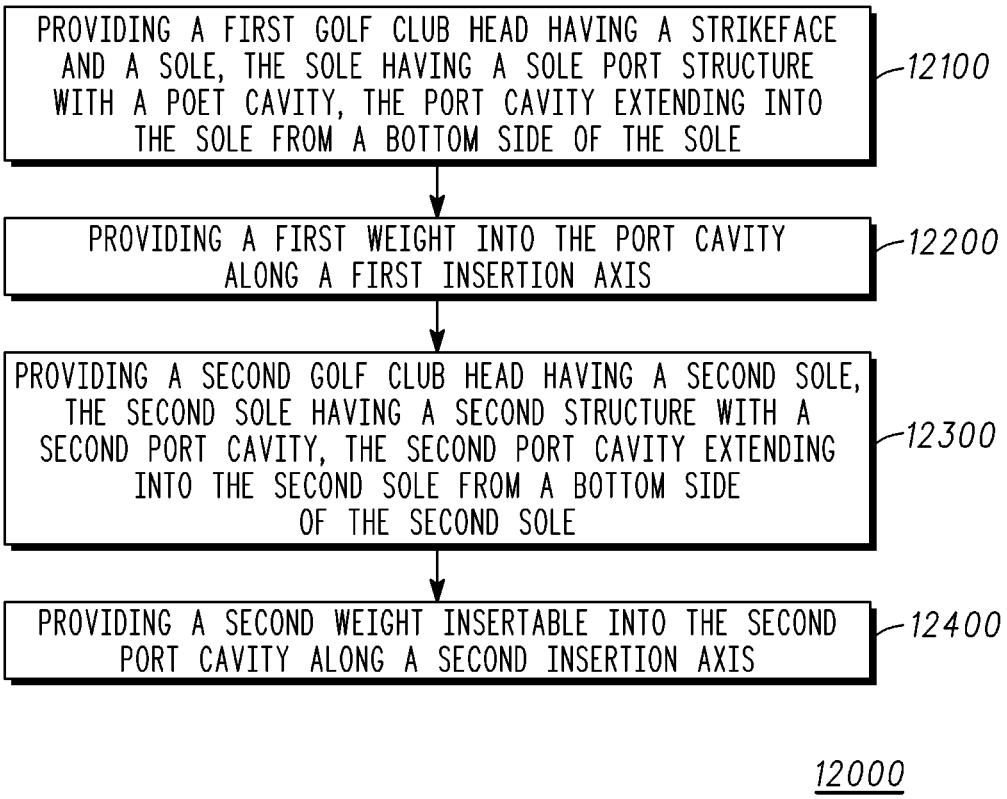
FIG. 12 illustrates a flowchart of a method for providing a golf club system.

FIG. 12 illustrates a flowchart of a method 12000 for providing a golf club system. In some examples, the golf club system can be similar to a system comprising one or more of the golf club heads of FIGS. 1-11 and/or variations thereof.

Block 12100 of method 12000 comprises providing a first golf club head having a strikeface and a sole, the sole having a sole port structure with a port cavity, the port cavity extending into the sole from a bottom side of the sole. In some examples, the first golf club head can be similar to golf club head 1000, the strikeface can be similar to strikeface 1110, the sole can be similar to sole 1500, the sole port structure can be similar to port structure 1600, and the port cavity can be similar to port cavity 1610 as described above with respect to FIGS. 1-8. The first golf club head can also be similar to one or more of golf club head 9000 (FIG. 9), golf club head 10000 (FIG. 10), and/or golf club head 11000 (FIG. 11).

Block 12200 of method 12000 comprises providing a first weight insertable into the port cavity along a first insertion axis. In some examples, the first weight can be similar to weight member 4800 (FIGS. 4-8) and the first insertion axis can be similar to insertion axis 4850 (FIGS. 4, 7, 8). The first weight also can be similar to one or more of weight member 9800 (FIG. 9), weight member 10800 (FIG. 10), and/or weight members 11800 and 11810 (FIG. 11).

Block 12300 of method 12000 comprises providing a second golf club head having a second sole, the second sole having a second sole port structure with a second port cavity, the second port cavity extending into the second sole from a bottom side of the second sole. In some embodiments the second golf club head can be similar to golf club head 8000, the strikeface can be similar to strikeface 8110, the sole can be similar to sole 1500, the sole port structure can be similar to port structure 8600, and the port cavity can be similar to port cavity 8610 as described above with respect to FIG. 8. The second golf club head also can be similar to one or more of golf club head 9000 (FIG. 9), golf club head 10000 (FIG. 10), and/or golf club head 11000 (FIG. 11).

Block 12400 of method 12000 comprises providing a second weight insertable into the second port cavity along a second insertion axis. In some examples, the second weight can be similar to weight member 8800 (FIG. 8) and the second insertion axis can be similar to insertion axis 8850 (FIG. 8). The second weight also can be similar to one or more of weight member 9800 (FIG. 9), weight member 10800 (FIG. 10), and/or weight members 11800 and 11810 (FIG. 11).

In some examples, some of the blocks of method 12000 can be optional. For example, blocks 12300 and 12400 can be optional. As another example, blocks 12200 and 12400 can be optional. There can be examples where different blocks of method 12000 can be combined into a single block or performed simultaneously, and/or where the sequence of such blocks can be changed. For example, blocks 12100 and 12200 can be carried out simultaneously, and/or blocks 12300 and 12400 can be carried out simultaneously. There can also be examples where method 2000 can comprise further or different blocks. As an example, method 12000 can comprise another block for providing further golf club heads and weight members for other golf clubs of a golf club set. As another example, method 12000 can comprise further blocks or sub-blocks for providing specific characteristics of the golf club heads and weight members described above with respect to FIGS. 1-11. Other variations can be implemented for method 12000 without departing from the scope of the present disclosure.

Although the golf club heads with sole cavity ports and related methods herein have been described with reference to specific embodiments, various changes may be made without departing from the spirit or scope of the present disclosure. As an example, cavity front wall 1612 may be biased such as to have a non-constant distance from shaft axis plane 1720. For instance, in such embodiments, cavity toe end 1615 can be closer to strikeface 1110 or closer to shaft axis plane 1720 than cavity heel end 1614, or vice-versa. Additional examples have been given in the foregoing description. Other permutations of the different embodiments having one or more of the features of the various figures are likewise contemplated. Accordingly, the disclosure herein is intended to be illustrative and is not intended to be limiting. It is intended that the scope of this application shall be limited only to the extent required by the appended claims.

The golf club heads with sole cavity ports and related methods discussed herein may be implemented in a variety of embodiments, and the foregoing discussion of certain of these embodiments does not necessarily represent a complete description of all possible embodiments. Rather, the detailed description of the drawings, and the drawings themselves, disclose at least one preferred embodiment, and may disclose alternative embodiments.

As the rules to golf may change from time to time (e.g., new regulations may be adopted or old rules may be eliminated or modified by golf standard organizations and/or governing bodies such as the United States Golf Association (USGA), the Royal and Ancient Golf Club of St. Andrews (R&A), etc.), golf equipment related to the apparatus, methods, and articles of manufacture described herein may be conforming or non-conforming to the rules of golf at any particular time. Accordingly, golf equipment related to the apparatus, methods, and articles of manufacture described herein may be advertised, offered for sale, and/or sold as conforming or non-conforming golf equipment. The apparatus, methods, and articles of manufacture described herein are not limited in this regard.

While the above examples may be described in connection with an iron-type golf clubs, the apparatus, systems, methods, and articles of manufacture described herein may be applicable to other types of golf club such as a fairway wood-type golf club, a hybrid-type golf club, an driver-type golf club, a wedge-type golf club, or a putter-type golf club. Alternatively, the apparatus, methods, and articles of manufacture described herein may be applicable other type of sports equipment such as a hockey stick, a tennis racket, a fishing pole, a ski pole, etc.

All elements claimed in any particular claim are essential to the embodiment claimed in that particular claim. Consequently, replacement of one or more claimed elements constitutes reconstruction and not repair. Additionally, benefits, other advantages, and solutions to problems have been described with regard to specific embodiments. The benefits, advantages, solutions to problems, and any element or elements that may cause any benefit, advantage, or solution to occur or become more pronounced, however, are not to be construed as critical, required, or essential features or elements of any or all of the claims, unless such benefits, advantages, solutions, or elements are expressly stated in such claims.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

The invention claimed is:

1. A golf club head comprising:

a face comprising a strikeface and a backside opposite the strikeface;

a head CG from which a gravity vector extends;

a shaft axis extended along a shaft axis plane;

a head heel portion;

a head toe portion; and a sole coupled to the face and comprising a material, a sole bottom side, and a sole port structure having a port cavity extending into the sole from the sole bottom side; and a weight insertable into the port cavity along an insertion axis;

wherein:

the sole port structure comprises:

a cavity opening located at the sole bottom side for access to the port cavity;

a cavity heel end at the head heel portion;

a cavity toe end at the head toe portion;

a cavity front wall toward the face and extended between the cavity heel end and the cavity toe end; and a cavity rear wall away from the face and extended between the cavity heel end and the cavity toe end; and a cavity thickness measured orthogonal to the insertion axis, between the cavity front wall and the cavity rear wall, wherein the cavity thickness varies along the cavity length;

the weight comprises a material having a density that varies along the cavity length;

the weight material comprises a density less than a density of the sole material;

the weight material is more flexible than the sole material;

when the weight is inserted into the port cavity via the cavity opening:

the weight is abutted against the cavity front wall and against the cavity rear wall;

when the golf club head is at address, with the shaft axis plane parallel to the gravity vector and orthogonal to a ground plane:

the port cavity comprises a cavity length, measured parallel to the ground plane, from the cavity heel end to the cavity toe end;

the strikeface comprises a strikeface length;

the cavity length is approximately 30% to approximately 90% of the strikeface length; and the head CG is defined by a combined mass of the golf club head and the weight when the weight is inserted in the port cavity;

the strikeface comprises a lower strikeface area defined by a lower portion of the strikeface located lower than the head CG relative to the ground plane; and the cavity front wall comprises an area of at least approximately 30% of the lower strikeface area.

2. The golf club head of claim 1, wherein:

when the golf club head is at address:

the port cavity comprises:

a cavity height, measured parallel to the insertion axis, between the cavity opening and a cavity inner end opposite the cavity opening;

a cavity center section, centered relative to the cavity length, and extending throughout approximately 75% of the cavity length; wherein the cavity length is at least 15 times greater than the cavity thickness.

3. The golf club head of claim 2, wherein:

the cavity length is at least 3 times greater than the cavity height.

4. The golf club head of claim 2, wherein:

the cavity length is at least approximately 70% of the strikeface length.

5. The golf club head of claim 1, wherein:

the cavity front wall comprises a cavity front wall area of approximately 250 $mm^2$ to approximately 400 $mm^2$ behind the strikeface.

6. The golf club head of claim 1, wherein:

when the golf club head is at address:

the head CG is defined by a combined mass of the golf club head and the weight when the weight is inserted into the port cavity; and the port cavity is located fully below the head CG.

7. The golf club head of claim 1, wherein:

the sole comprises a maximum sole thickness measured orthogonal to the shaft axis plane; and when the golf club head is at address:

the port cavity comprises:

a cavity height, measured parallel to the insertion axis, between the cavity opening and a cavity inner end opposite the cavity opening;

a cavity center section, centered relative to the cavity length, and extending throughout approximately 75% of the cavity length; and the cavity thickness is approximately 8% to approximately 50% of the maximum sole thickness.

8. The golf club head of claim 7, wherein:

the cavity thickness varies from approximately 2 mm to approximately 10 mm.

9. The golf club head of claim 1, wherein:

when the golf club head is at address:

the sole port structure comprises:

a port structure top end at an exterior of the sole port structure and opposite the cavity opening; and a port top end distance, measured from the port structure top end to the ground plane and parallel to the gravity vector, is approximately 5 mm to approximately 20 mm.

10. The golf club head of claim 9, wherein:

the golf club head is devoid of a weight-securing rib extended, above the port structure top end, from the head heel portion to the head toe portion, and along the backside of the face.

11. The golf club head of claim 9, wherein:

the sole port structure comprises a cavity inner end opposite the cavity opening and located between the cavity opening and the port structure top end; and a port top thickness, measured from the port structure top end to the cavity inner end and parallel to the gravity vector, is up to approximately 5 mm.

12. The golf club head of claim 1, wherein:

the sole port structure comprises a cavity inner end opposite the cavity opening; and a cavity height, measured from the cavity inner end to the cavity opening and parallel to the insertion axis, is approximately 2 mm to approximately 18 mm.

13. The golf club head of claim 1, wherein:

when the golf club head is at address:

the golf club head comprises:

the head CG defined by a combined mass of the golf club head and the weight when the weight is inserted in the port cavity;

a head CG height, measured from the head CG to the ground plane and parallel to the gravity vector;

the weight comprises:

a weight CG;

a weight CG height, measured orthogonal to the ground plane, between the weight CG and the ground plane; and a difference between the head CG height and the weight CG height is approximately 5 mm to approximately 20 mm.

14. The golf club head of claim 1, wherein:

when the golf club head is at address:

the head CG is defined by a combined mass of the golf club head and the weight when the weight is inserted in the port cavity; and a head CG height, measured from the head CG to the ground plane and parallel to the gravity vector, is approximately 10 mm to approximately 30 mm.

15. The golf club head of claim 1, wherein:

the golf club head comprises:

the cavity front wall depth is approximately 2 mm to approximately 15 mm, measured orthogonal to the strikeface at a minimum distance from the strikeface to the cavity front wall.

16. The golf club head of claim 1, wherein:

when the golf club head is at address:

the weight comprises:

a weight CG; and a weight CG vertical plane intersecting the weight CG parallel to a shaft angle plane;

the golf club head comprises:

a leading edgepoint at a frontmost point of a leading edge of the strikeface;

a face leading plane intersecting the leading edgepoint parallel to the shaft angle plane; and a weight CG depth of approximately 4 mm to approximately 12 mm, measured orthogonal to the shaft angle plane at a minimum distance from the face leading plane to the weight CG vertical plane.

17. The golf club head of claim 16, wherein:

when the golf club head is at address:

the golf club head comprises:

the head CG defined by a combined mass of the golf club head and the weight when the weight is inserted in the port cavity;

a head CG vertical plane intersecting the head CG parallel to the shaft angle plane; and a head CG depth, measured orthogonal to the shaft axis plane, from the face leading plane to the head CG vertical plane; and a difference between the head CG depth and the weight CG depth is approximately −10 mm to approximately 10 mm.

18. The golf club head of claim 1, wherein:

when the golf club head is at address:

the golf club head comprises a bounce angle between the ground plane and a bounce angle axis;

the port cavity comprises a cavity-bounce angle measured between the insertion axis and the bounce axis;

the port cavity comprises a cavity-ground angle measured between the insertion axis and the ground plane;

the cavity-bounce angle is approximately 70 degrees to approximately 110 degrees.

19. The golf club head of claim 18, wherein:

the cavity-ground angle is approximately 60 degrees to approximately 100 degrees; and the cavity-bounce angle is substantially orthogonal to the bounce angle axis.

20. The golf club head of claim 1, wherein:

the weight is a thermoplastic elastomer or a thermoplastic polyurethane.

* * * * *